United States Patent [19]

Nikaido et al.

[11] Patent Number: 4,760,728

[45] Date of Patent: Aug. 2, 1988

[54] METHOD FOR REDUCING WIDTHS OF HOT SLABS

[75] Inventors: Hideyuki Nikaido; Takayuki Naoi, both of Kurashiki; Atsushi Komori; Mitsuo Nihei, both of Hitachi, all of Japan

[73] Assignees: Kawasaki Steel Corporation, Kobe; Hitachi, Ltd., Tokyo, both of Japan

[21] Appl. No.: 921,549

[22] Filed: Oct. 21, 1986

[30] Foreign Application Priority Data

Nov. 22, 1985 [JP] Japan ..... 60-261307

[51] Int. Cl.[4] ..... B21J 5/00

[52] U.S. Cl. ..... 72/407; 72/402

[58] Field of Search ..... 72/407, 402, 76, 452

[56] References Cited

U.S. PATENT DOCUMENTS

| | | | |
|---|---|---|---|
| 3,495,427 | 2/1970 | Balamuth | 72/402 |
| 3,834,214 | 9/1974 | Kralowetz | 72/407 |
| 4,578,983 | 4/1986 | Kimura | 72/407 |

FOREIGN PATENT DOCUMENTS

| | | |
|---|---|---|
| 112516 | 7/1984 | European Pat. Off. . |
| 157575 | 9/1985 | European Pat. Off. . |
| 2062522 | 5/1981 | United Kingdom . |

OTHER PUBLICATIONS

Patent Abstracts of Japan, vol. 7, No. 9 (M-185)[1154], Jan. 14, 1983; & JP-A-57 168 707 (Ishidawajima Harima Jukogyo K.K.).

Patent Abstracts of Japan, vol. 8, No. 43 (M-279)[1480], Feb. 24, 1984; & JP-A58 199 601 (Sumitomo Kinzoku Kogyo K.K.) 21-1183.

Patent Abstracts of Japan, vol. 9 No. 275 (M-426) [1998], Nov. 2, 1985; & JP-A-60121 001 (Hitachi) 6/28/1985.

Patent Abstracts of Japan, vol. 7, No. 137 (M-222) [1282], Jun. 15, 1983; & JP-A-5853301 (Hitachi Seisakusho K.K.) 3/29/1983.

*Primary Examiner*—Daniel C. Crane

*Attorney, Agent, or Firm*—Balogh, Osann, Kramer, Dvorak, Genova & Traub

[57] ABSTRACT

A press apparatus for reducing widths of hot slabs comprises a pair of anvils movable toward and away from each other in width directions of the hot slabs, width reduction heads to which the pair of anvils are attached, respectively, and eccentric presses for reciprocatively driving the width reduction heads through sliders, respectively. The apparatus further comprises width adjusting means incorporated in the eccentric presses, respectively, for changing distances between the width reduction heads and the sliders. Each of the anvils has a parallel portion in parallel to a feeding direction of the hot slabs and an inclined portion on an entry side in the feeding direction. With this arrangement, the reducing distance can be set according to the desired distance of reduction in width in continuous width reduction and the reduction in width can be continuously effected with the set reducing distance with high efficiency. The press apparatus preferably further comprises buckling preventing means such as rollers controlled by hydraulic cylinders for urging at least two locations of the slab along a central longitudinal line of the slab and on upstream and downstream sides of a line connecting junctions of the parallel portions and the inclined portions of the anvils, thereby preventing any buckling of the slab occurring in reduction in width of the slab.

3 Claims, 13 Drawing Sheets

METHOD FOR REDUCING WIDTHS OF HOT SLABS

BACKGROUND OF THE INVENTION

This invention relates to a press apparatus for reducing widths of hot slabs by repeatedly pressing hot slabs in their width directions every feeding the slabs relatively to anvils, and a method of reducing the widths of the hot slabs by the use of the press apparatus.

It is very advantageous to change or reduce widths of slabs produced by continuous casting according to widths of plate products to be produced from the slabs before rolling in roughing mills. In this case, presses are effectively applied for the reduction in width, particularly, when widths to be reduced are large.

In reducing widths of slabs, it has been mainly used to combine "V-rolling" using vertical rolls and "H-rolling" using horizontal rolls. In order to prevent irregular shapes such as "fishtails" or "tongues" produced at preceding and trailing ends of slabs, a feature of preforming-pressing the preceding or trailing ends of slabs to prevent the irregular shapes has been disclosed in Japanese Laid-open Patent Application No. 58-53,301, wherein press apparatuses and vertical and horizontal rolling mills are provided to effect reversing rolling using vertical and horizontal rolls after pressing by the press apparatuses.

In order to carry out the width reducing method in existing hot rolling factories, strong vertical type reverse rolling mills, horizontal type reverse rolling mills and preforming presses for pressing preceding and trailing ends of slabs are needed. In fact, it is very difficult to obtain a wide space for locating these bulky apparatuses, and they increase initial cost of the installation.

In Japanese Laid-open Patent Application No. 59-101201, on the other hand, a continuous width reducing method with a press for slabs has been disclosed which is able to save a space and to decrease the initial cost of the installation. In this method, however, distances to be reduced in width of slabs should be set according to required reduced widths of slabs when initial widths of the slabs or widths of plate products are within various ranges. Such a setting of widths may detrimentally affect the efficiency in working for the continuous width reduction.

In reducing widths of slabs, moreover, buckling often occurs in the slabs. FIG. 1 illustrates relations between patterns of pressing slabs and shapes of buckling in the slabs. When a preceding end has been preformed, a large buckling would occur in the preceding end of the slab as shown in FIG. 1(*a*). When a trailing end has been preformed, a large buckling also occurs in the trailing end of the slab as shown in FIG. 1(*c*). In both the cases, the large bucklings occur at the free ends. In steady pressing that intermediate portions of slabs are pressed without preforming as shown in FIG. 1(*b*), a buckling is smaller than in the both cases of FIGS. 1(*a*) and 1(*c*). However, the buckling continues in the longitudinal direction to form one half of a pipe longitudinally split. In case of that steady pressing is continued to a trailing end without preforming the trailing end, the buckling becomes larger as the pressing becomes near to the trailing end so that the reduction in width to the trailing end is often impossible as shown in FIG. 1(*d*). When such bucklings are small, the inherently aimed change in width of slabs is impossible because the reduction in width of slabs is small. On the other hand, when such bucklings are large, it becomes difficult to cause the slabs to pass through rolling mills in addition to the impossibility of the change in width. Accordingly, it is absolutely necessary to prevent the buckling.

In the width reduction by vertical and horizontal roll rolling mills hitherto used, there is a possibility of buckling in rolling with the vertical rolling mills. Accordingly, the maximum value $\Delta w$ of width reduction is usually set to be $\Delta W < \frac{1}{2}T_0$, where $T_0$ is the initial thickness of the slab, so that the width reduction is effected within a range less than the limit value for preventing the buckling. With a sizing mill capable of controlling tensile forces between the vertical and horizontal roll rolling mills, tensile force is applied by the horizontal rolling mill on an exit side to a slab being rolled by the vertical rolling mill so as to increase the limit value to make large the reduction in width of the slab. However, this method also remains in the fact that the reduction in width is limited by the above limit value for preventing the buckling.

In contrast herewith, it has been also proposed to positively hold a slab by a set of holding rolls arranged at a center of width of the slab on an axis connecting vertical rolls of an edger in order to avoid the buckling (Japanese Laid-open Patent Application No. 57-168707). Moreover, the feature of providing two sets of holding rolls on both sides of a center of width of the slab is disclosed in a text of lecture meeting "Iron and steel" published by Japanese Iron and Steel Society, autumn of 1983, 69-5 (1983) S350, 349. These methods make possible the reduction in width of slabs beyond above limit value.

In reducing width of hot slabs by means of a press using anvils having flat portions in parallel to proceeding direction of the slabs and inclined portions at their front and rear ends, on the other hand, there are three patterns of pressing, i.e., preforming preceding ends, preforming trailing ends and steady pressing, and deformed zones of the slabs are large. As a result, the buckling is likely to occur when the reduction in width is large. It has been found that only one holding position by holding means between anvils is insufficient.

SUMMARY OF THE INVENTION

It is an object of the invention to provide a press apparatus whose width reduction heads can be moved relatively to anvils to make easy the setting of distances to reduce in width of slabs according to required aimed widths.

In order to achieve this object, a press apparatus for reducing widths of hot slabs according to the invention comprises a pair of anvils movable toward and away from each other in width directions of the hot slabs, each of said anvils having a parallel portion in parallel to a feeding direction of the hot slabs and an inclined portion on an entry side in the feeding direction; width reduction heads to which said pair of anvils are attached, respectively; eccentric presses for reciprocatively driving said width reduction heads through sliders, respectively; and width adjusting means incorporated in said eccentric presses, respectively, for changing distances between said width reduction heads and said sliders.

It is another object of the invention to provide a method of reducing the widths of hot slabs by the use of the press apparatus.

To this end, in a method of reducing widths of hot slabs using eccentric presses for reciprocatively driving through sliders width reduction heads to which are respectively attached a pair of anvils movable toward and away from each other in width directions of the hot slabs, each said anvil having a parallel portion in parallel to a feeding direction of the hot slabs and an inclined portion on an entry side in the feeding direction, the method according to the invention comprises steps of setting a distance to reduce a width of a slab either side by said anvils by moving said width reduction heads toward and away from said sliders, and feeding the hot slab intermittently with a pitch determined by a shape of said anvils and reducing conditions to effect the reduction in width of the slab in succession.

It is a further object of the invention to provide a press apparatus capable of preventing any buckling in hot slabs occurring when reduction in width of the slabs is effected by the press apparatus.

In order to achieve this object, the press apparatus according to the invention, further comprises buckling prevention means comprising holding means for urging more than two locations of the slab along a central longitudinal line of the slab and on upstream and downstream sides of a line connecting junctions of the parallel portions and the inclined portions of the anvils, thereby preventing any buckling of the slab occurring in reduction in with of the slab.

This invention will be more fully understood by referring to the following detailed specification and claims taken in connection with the appended drawings.

Figure 12A:
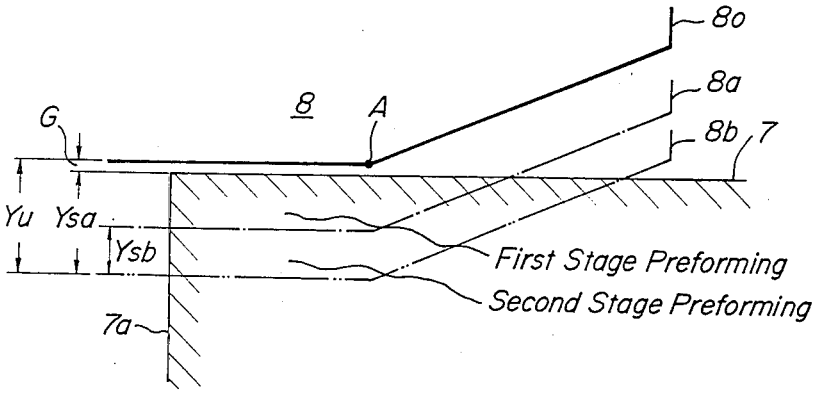
Figure 12B:
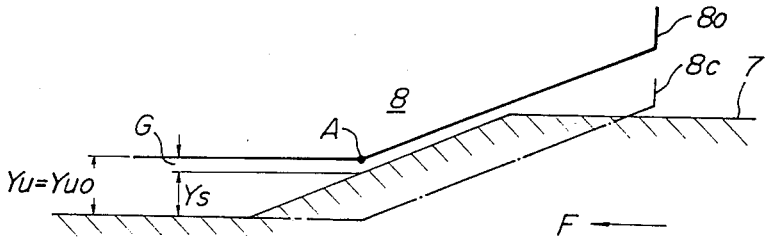
Figure 12C:
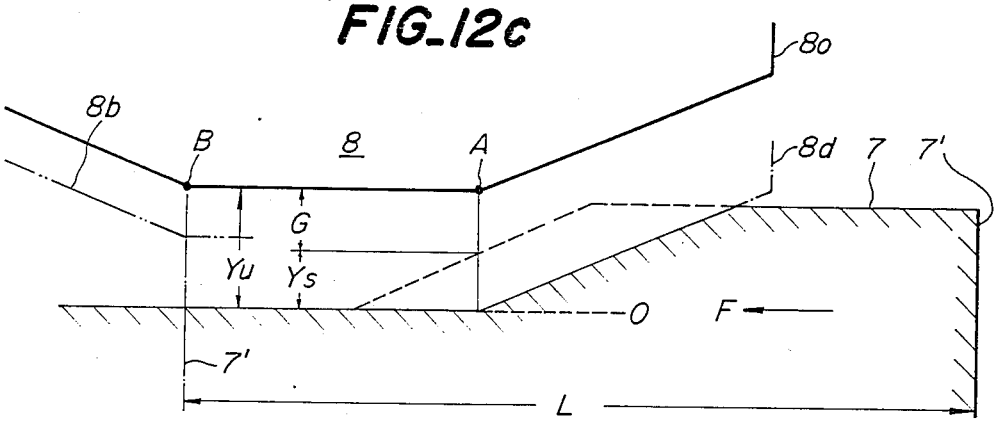
Figure 14:
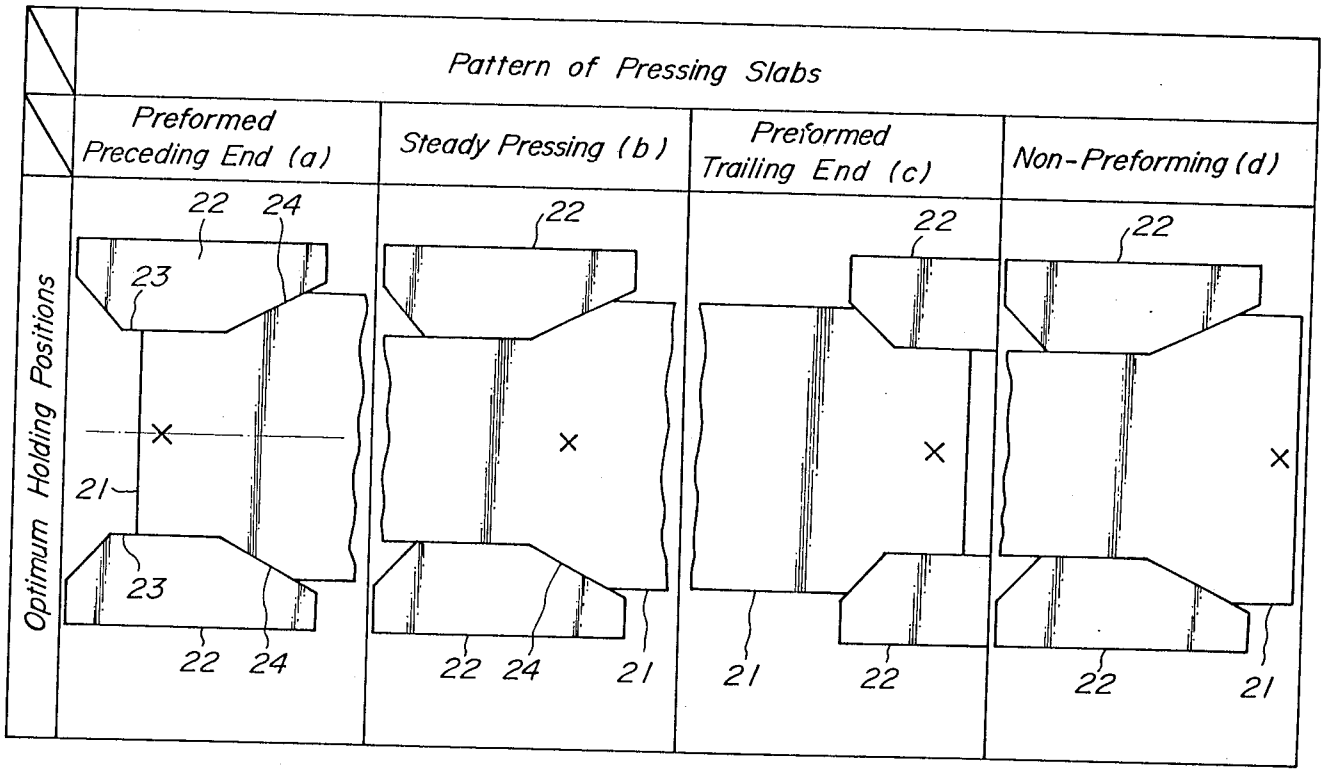
Figure 15:
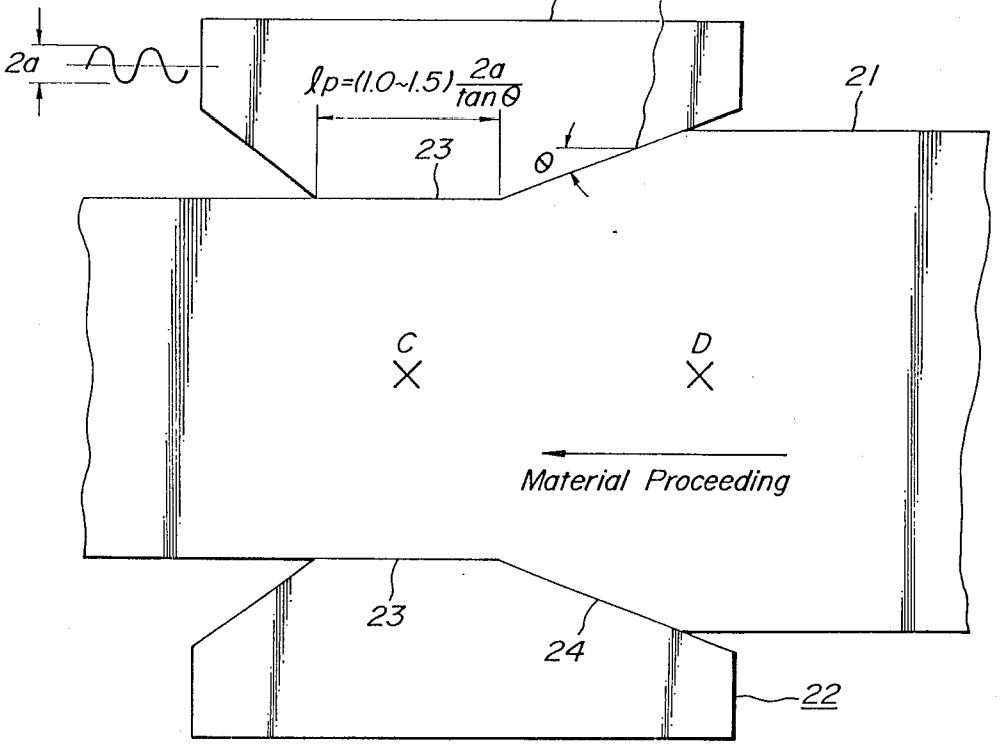
Figure 16:
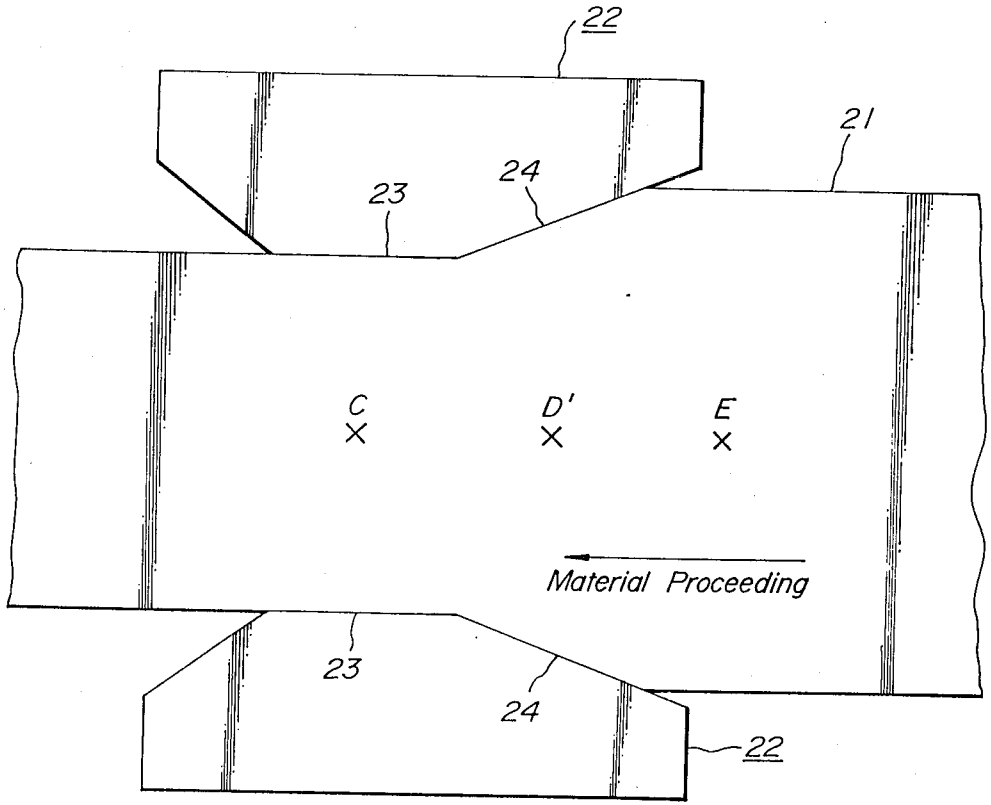
Figure 17:
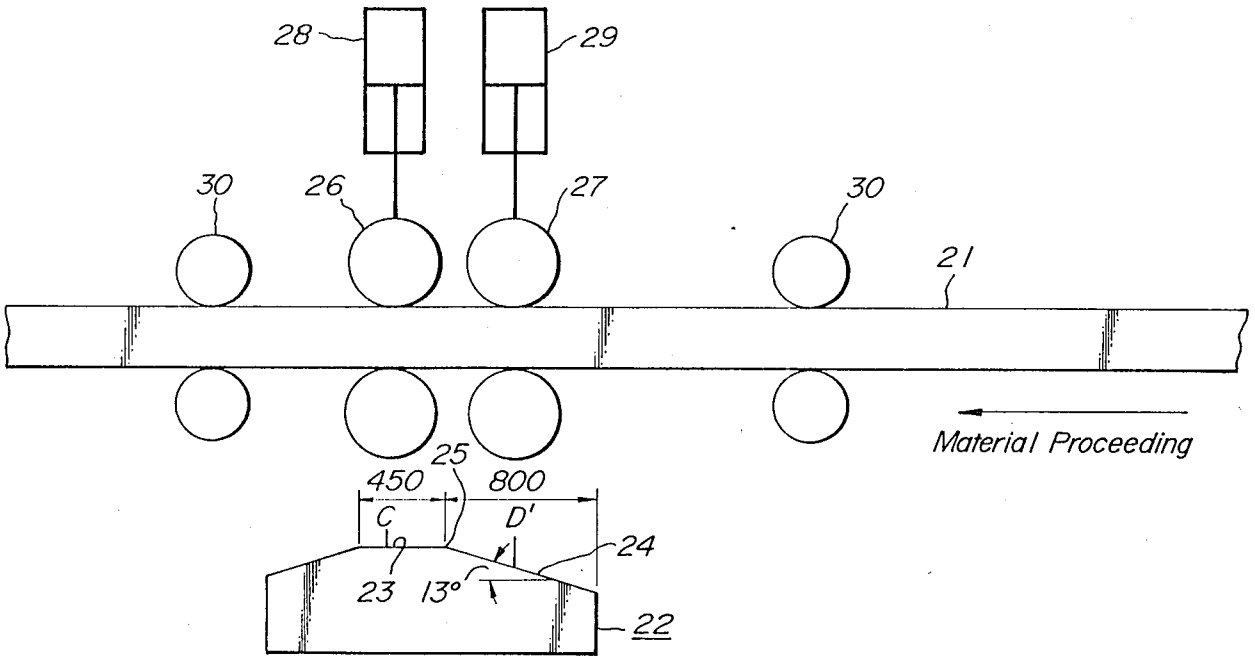
Figure 18:
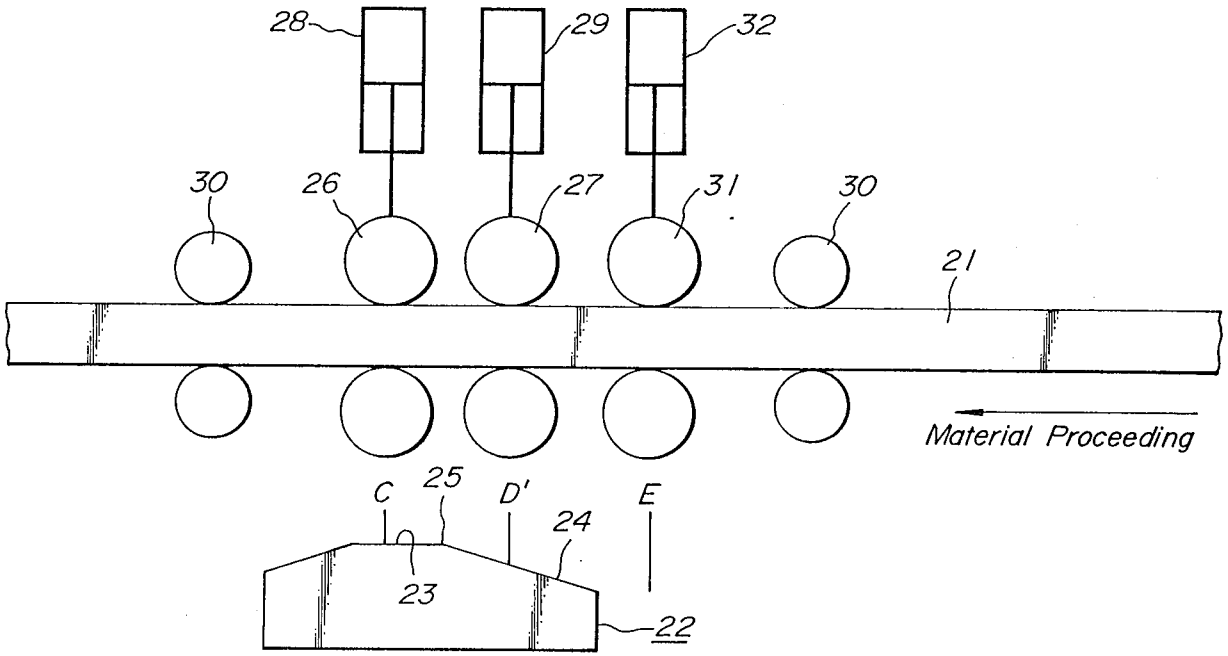

FIGS. **12*a*–12*c*** are illustrations showing the relation between a slab and an anvil in reducing in width of the slab according to the invention;

FIGS. **13*a*–13*d* are illustrations for explaining relations between the lapse of time and the operation of the anvil and the slab shown in FIGS. 12*a*–12*c***;

FIG. 14 is an illustration of holding positions for patterns of pressing in order to prevent buckling;

FIG. 15 is a plan view illustrating two locations for preventing buckling;

FIG. 16 is a plan view illustrating three locations for preventing buckling;

FIG. 17 is a front view illustrating on embodiment of the buckling preventing device for the press apparatus according to the invention; and FIG. 18 is a front view illustrating a second embodiment of the buckling preventing device according to the invention.

DESCRIPTION OF THE PREFERRED EMBODIMENTS

Figure 1:
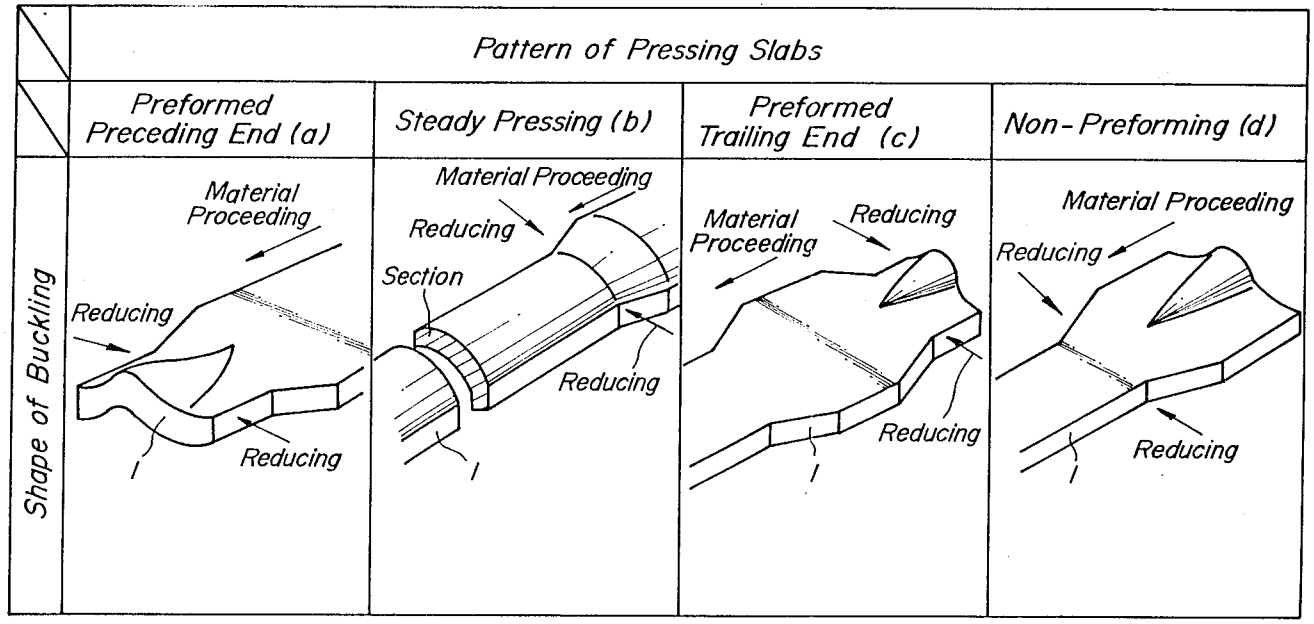
FIG. 1 PRIOR ART
FIG. 1 is an illustration of patterns of pressing slabs to cause bucklings in slabs according to the prior art.
Figure 2:
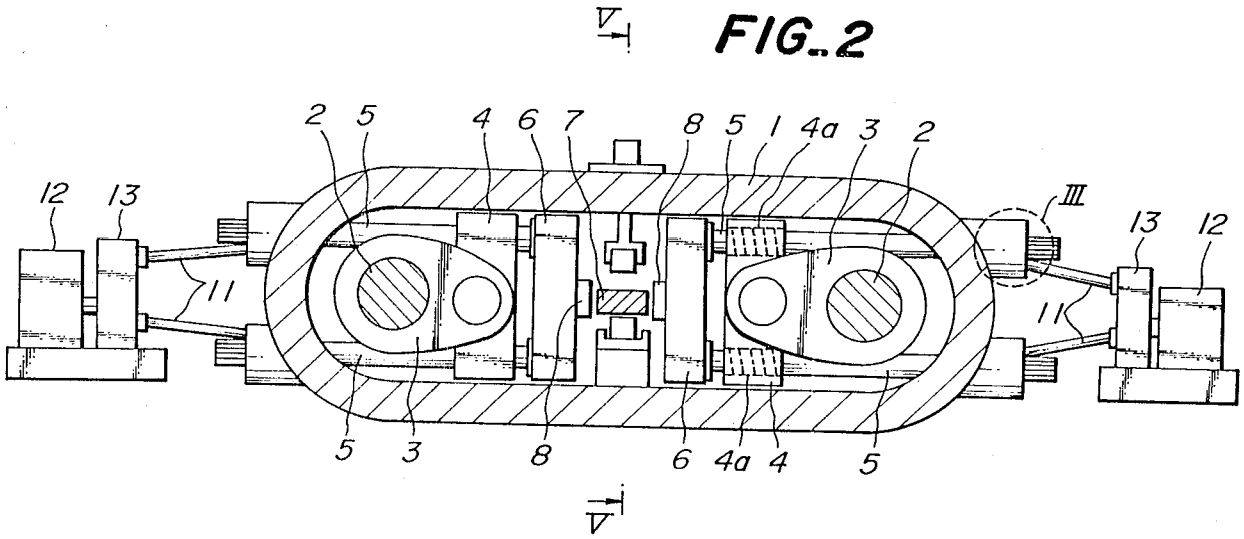
FIG. 2 is a schematic view illustrating a press apparatus according to the invention.

A width reducing press apparatus according to the invention will be explained by referring to FIG. 2 which incorporates eccentric presses therein using crankshafts.

In the drawing, the press apparatus comprises a housing 1, crankshafts 2 rotatably extending through the housing 1, and sliders 4 connected through connecting rods 3 to the crankshafts 2 and slidable along inner walls of the housing 1. Each of the sliders 4 is reciprocatively driven through the connecting rod 3 and the crankshaft 2 driven by a motor (not shown).

Each of the sliders 4 is formed with four internally threaded apertures **4*a* in which threaded portions of screw-threaded rods 5 are threadedly engaged. A width reduction head 6 is fixed to one ends of the screw-threaded rods 5. An anvil 8 is fixed to the width reduction head 6 for reducing the width of a slab 7**.

Figure 3:
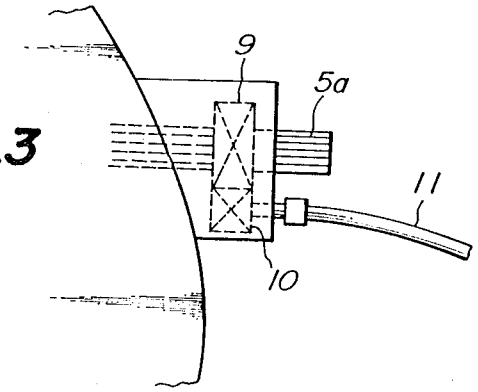
FIG. 3 is a partial view for explaining a part encircled by a broken line III of the apparatus shown in FIG. 2.

Moreover, each of the screw-threaded rods 5 is formed on the other end with spline grooves **5*a* on which is engaged a splined gear 9 in mesh with a pinion 10 as shown in FIG. 3. The pinion 10 is rotated through a universal spindle 11 by a reduction gear device 13 connected to a motor 12 to rotate the screw-threaded rod 5 through the splined gear 9. As the screw-threaded rods 5 are rotated, they axially move in the internally threaded apertures 4*a* of the slider 4 to change a relative position between the slider 4 and the width reduction head 6 fixed to the ends of the screw-threaded rods 5, thereby enabling the position of the anvil 8 to be adjusted. Such an adjustment of the relative position between the slider 4 and the width reduction head 6** is referred to herein "width adjustment" whose function will be clear in the later explanation.

Figure 4:
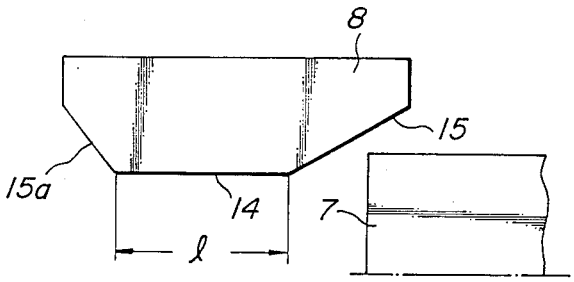
FIG. 4 is an explanatory view of the anvil used for the press apparatus according to the invention.

Moreover, each the anvil 8 includes a parallel portion 14 in parallel with a proceeding direction of the slab 7, an inclined portion 15 at a rear end or an entry side facing to the proceeding slab 7, and an inclined portion **15*a* on a front end or an exit side. However, the inclined portion 15*a* on the exit side is not necessarily needed when preforming the trailing end of the slab 7 is not effected as shown in FIG. 4**.

Although only members associated with the one anvil 8 have been explained, more members associated with the other anvil 8 are of course provided to form one press apparatus.

Figure 5:
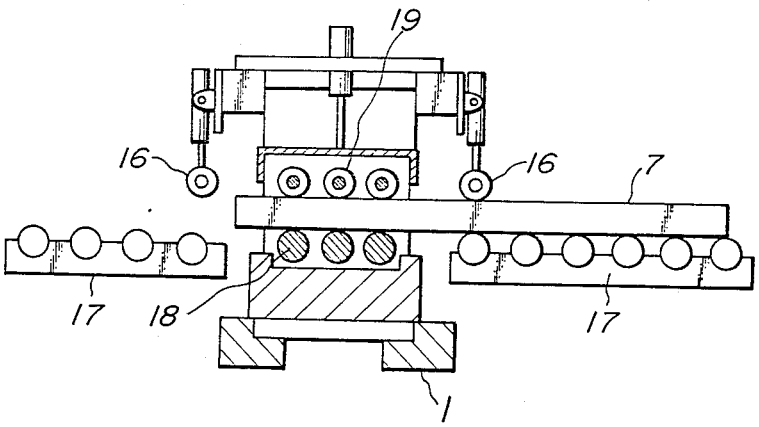
FIG. 5 is a sectional view taken along a line V—V in FIG. 2.

Moreover, the slab 7 is transferred by pinch rolls 16 and a high speed transferring roller table 17. If required, lower buckling preventing rollers 18 and upper buckling preventing rollers 19 may be provided in the housing 1 in order to prevent the buckling of the slab produced in reducing the width of the slab as shown in FIG. 5.

The reduction in width of the slab will be explained by referring to FIGS. 6–10. For the sake of convenience of explanation, only the operation of the one anvil 8 will be explained. In fact, however, a pair of the anvils are of course operated.

Figure 6:
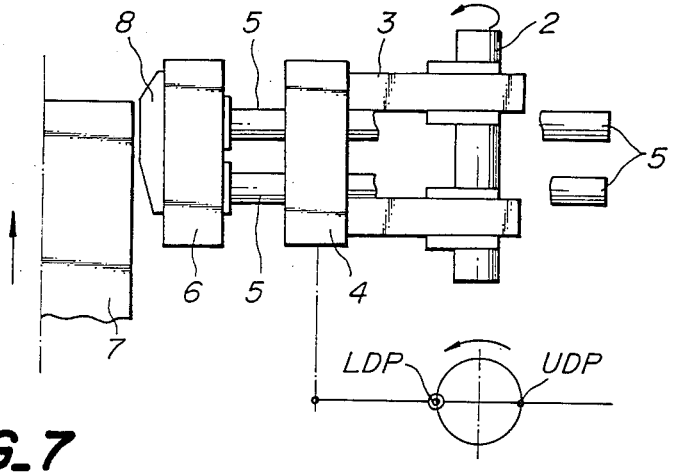
FIGS. 6–10 are illustrations for explaining the reduction in width of hot slabs according to the invention.

As shown in FIG. 6, the slab 7 is fed between the anvils 8 which have been set whose minimum distance therebetween is wider than a width of the slab 7 and stopped so as to permit a preceding end of the slab to be positioned at a location where an unsteady deformation caused by the preforming is minimum.

The crankshaft 2 starts from a lower dead point (LDP in FIG. 6) to an upper dead point (UDP) to widen the distance between the slab 7 and one of the anvils 8. Therefore, during the movement of the crankshaft 2 from the lower dead point to the upper dead point, the screw-threaded rods 5 are rotated so as to move in its axial direction, so that the width reduction head 6 is moved relatively to the slider 4 so as to approach to the slab 7 (FIGS. 7 and 8).

Figure 7:
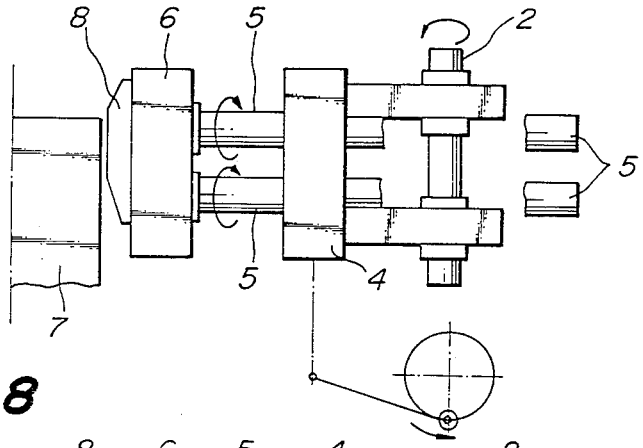
Figure 8:
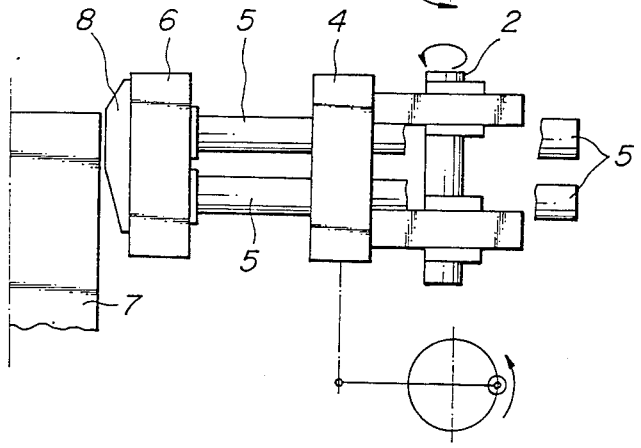
Figure 9:
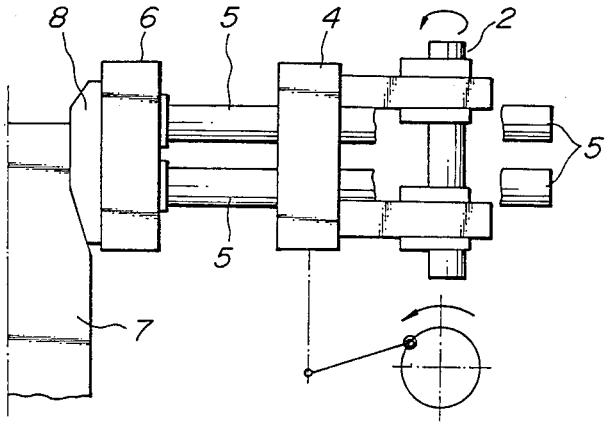

Furthermore, while the relative position between the slider 4 and the width reduction head 6 as shown in FIG. 7 is kept, the crankshaft 2 moves from the upper dead point to the lower dead point so that the reduction in width of the slab is accomplished (FIG. 9).

Moreover, if it is required to effect the reduction in width more than two times the stroke of the crankshaft, the above reduction in width is repeatedly effected many times. Furthermore, the preforming of the trailing end of the slab can be effected in the same manner as that of the preceding end of the slab. Namely, before an irregular shape such as a "tongue" occurs at the trailing end of the slab, the slab is fed onto the exit side and the preforming of the trailing end is effected with an inclined portion 15*a* of the anvil at its front end or an exit side in the same manner as that of the preceding end. It is also possible to effect the preforming of the trailing end prior to the preforming of the preceding end.

Figure 10:
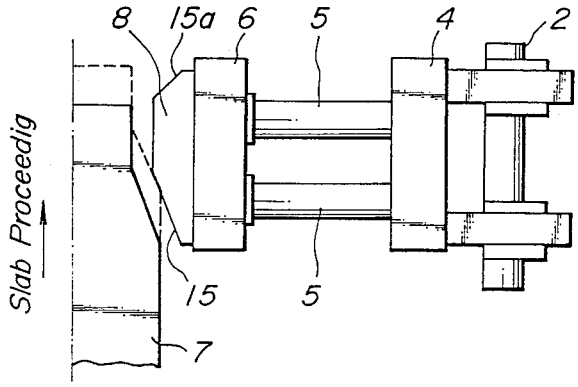

After the width reduction of the slab has been effected, the slab is fed at a higher speed as shown in FIG. 10. When the crankshaft 2 is rotated, the anvil 8 is operated with a constant stroke. When the anvil 8 is moved during the movement of the crankshaft 2 from the lower dead point to the upper dead point, the anvil 8 moves away from the slab 7. Accordingly, the slab 7 is fed between the pair of anvils 8 during the movement of the crankshaft 2 to the upper dead point, and the next reduction in width is effected during the movement of the crankshaft 2 from the upper dead point to the lower dead point.

The slab is fed in increments of a predetermined distance which is referred to herein "pitch P" indicated in the following formulas, where an inclined angle of the inclined portion 15 of the anvil 8 is $\theta$, a reduced distance of the slab 7 by one anvil 8 in one reduction is Y, a stroke of the anvil 8 is $S_t$, and a distance of width of the slab to be reduced is $\Delta w$.

$$P = Y \cdot \tan(90° - \theta) \quad (1)$$

where $\Delta w/2 > S_t \geqq Y$ $$P \leqq l \text{(length of the parallel portion of the anvil)} \quad (2)$$

Figure 11:
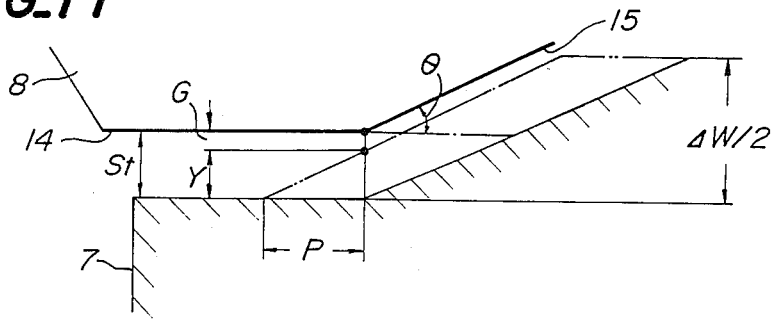
FIG. 11 is an explanatory view for the pitch of hot slab feeding.

The slab is fed with this pitch and the reduction in width continues. A gap G in FIG. 11 serves to prevent any collision of the slab with the anvils.

Referring to FIGS. 12*a*–12*c* and 13*a*–13*d*, the relation between a slab and an anvil will be explained in case of that a rotating radius of crankshafts is 50 mm, the reduced distance in width of slabs by one anvil is 175 mm, and the angle $\theta$ of inclined portion of the anvil is 12°.

In these figures, $Y_{uo}$ is the movement of the anvil caused by the rotation of the crankshaft or the movement of the slider, $Y_w$ is the width adjustment amount (in other words, the movement of the width reduction head), and $Y_u$ is the substantial or actual movement of the anvil ($Y_{uo}+Yw$). In this case, $Y_s$ indicates the variation in the distance between the side edge of the slab and the reduced position to be aimed by one anvil in a vertical line passing through the point A of the anvil. The gap G is the distance between the slab and the anvil.

FIG. 12*a* illustrated a condition of preforming a preceding end of the slab 7. The anvil 8 is illustrated in an awaiting or posing position $8_o$ in solid lines and in first and second stage preforming positions 8*a* and 8*b* in phantom lines. In this case, as the rotating radius of the crankshaft is 50 mm and its stroke is 100 mm, two stages of reduction with reduced distances $Y_{sa}=85$ mm and $Y_{sb}=90$ mm are required in order to achieve the reduced distance of $\Delta W/2=175$ mm. The $Y_{sa}$ is 85 mm+90 mm=175 mm and the $Y_{sb}$ is 90 mm.

FIG. 12*b* illustrates a condition of the steady reduction. The positions $8_o$ and $8_c$ of the anvil correspond to the positions of the crankshaft at the upper dead point and lower dead point, respectively. The slab 7 is fed at a high speed from the position where the preceding reduction has been completed corresponding to the position 8*c* shown in FIG. 12*a* to the position shown in solid lines in a direction shown by an arrow F to effect a next reduction in width of the slab. In this case, the fed distance of the slab or the pitch is approximately 400 mm calculated from $85(\text{mm}) \times \tan(90° - 12°) \simeq 400$ mm, where the gap is 15 mm and the reduced distance is $Y_s=85$ mm.

FIG. 12*c* illustrates a preforming a trailing end of the slab 7. For example, when the reduction in width of the slab has proceeded to a predetermined position in the proximity of the trailing end (corresponding to the position 8*d* of the anvil 8), the pair of anvils 8 are once opened to the positions $8_o$ where the anvils 8 do not interfere with the slab 7 and the slab 7 is advanced by a distance L in the direction F. The slab 7 is stopped when the trailing end 7′ arrives at a starting point B of the inclined portion of the anvil at its front end or the exit end, and the first and second stage preformings at the trailing end are effected.

FIGS. 13*a*–13*d* illustrate the operation of one anvil corresponding to lapse of time during the preforming the preceding end, the steady reduction in width and the preforming the trailing end of the slab.

In these drawings, abscissas indicate the lapse of time (t=0 is the starting point) and ordinates show positions Y of the anvil in the width direction (Y=0 corresponds to the edge of the slab completely reduced in width or a location of 175 mm from an initial edge of the slab which has not been reduced in width). A letter S is a point from which the anvil starts, and a letter P is a point from which the reduction in width of the slab starts by the anvil. A letter Z is a point at which the width adjustment has completed.

Figure 13A:
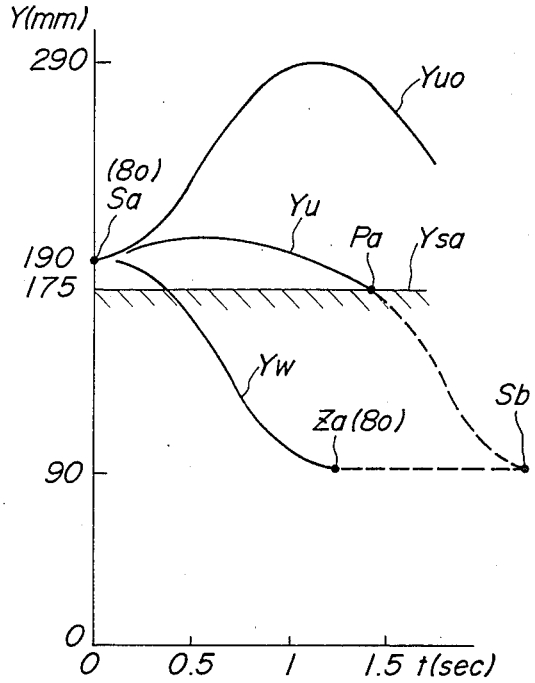

In FIG. 13*a*, the anvil poses or awaits at a point $S_a$ of 190 mm with the gap of 15 mm for the first stage preforming. The crankshaft starts to rotate from the lower dead point toward the upper dead point, so that this movement of the crankshaft causes the anvil moves along a curve $Y_{uo}$. On the other hand, the width adjustment is effected along a curve $Y_w$ slightly behind the movement of the anvil along the curve $Y_{uo}$ and is stopped at a point $Z_a$ after the width adjustment is 100 mm. Therefore, the actual movement of the anvil is shown by a curve $Y_u$. The first stage preforming is completed at a point $S_b$. In this case, after the crankshaft has been returned from the lower dead point to the upper dead point, the reduction in width of the slab is started. The reason is that if the reduction is started when the crankshaft is still at a position near to the upper dead point, the torque produced from the motor is insufficient to carry out the reduction so that the reduction in width may become impossible.

Figure 13B:
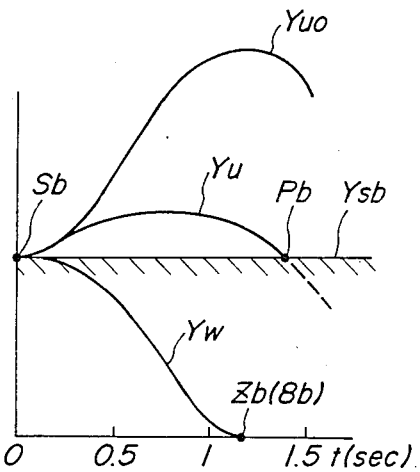

FIG. 13*b* illustrates the second stage preforming at the preceding end of the stab continuously following to the above first stage preforming. In this case, an amount of the width adjustment is 90 mm because the total reduced distance by the anvil in the first and second stage preformings is 175 mm and the switch adjustment of 85 mm in the first stage has been completed.

Figure 13C:
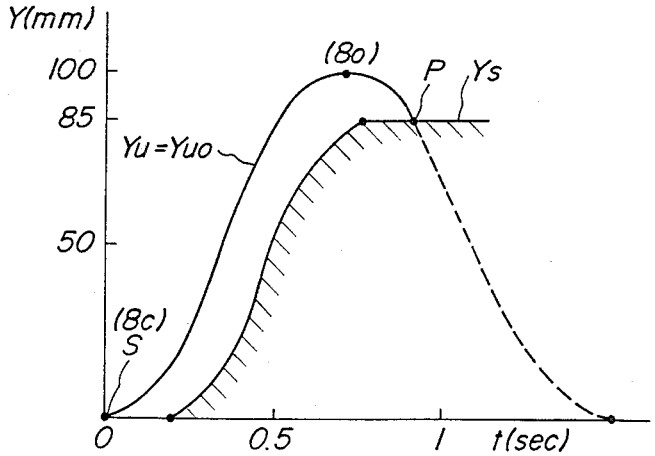

FIG. 13*c* illustrates the continuous steady width reduction. In this case, the width adjustment is not needed as shown in FIG. 12B and the anvil moves along a line $Y_u = Y_{uo}$ by the rotation of the crankshaft. On the other hand, the slab starts to move slightly behind the crankshaft passing through the lower dead point S and stops short of the reduction starting point P. This stopped position of the slab is set so that the gap G is 15 mm and $Y_s$ is 85 mm at the location corresponding to the point A of the anvil (FIG. 12*b*) from which the inclined portion 15 of the anvil on the rear or entry side starts. In FIG. 13*c*, as the side edge of the slab corresponding to the point A of the anvil is the position where the width reduction has been completed, $Y_s$ is zero at its initial time. As the slab is advancing $Y_s$ increases. When $Y_s$ arrives at 85 mm (the distance to be reduced), the slab is stopped. The reduction in width is started from the point P where the lines $Y_s$ and $Y_u$ intersect. The reduction continues to the point where $Y=0$.

Figure 13D:
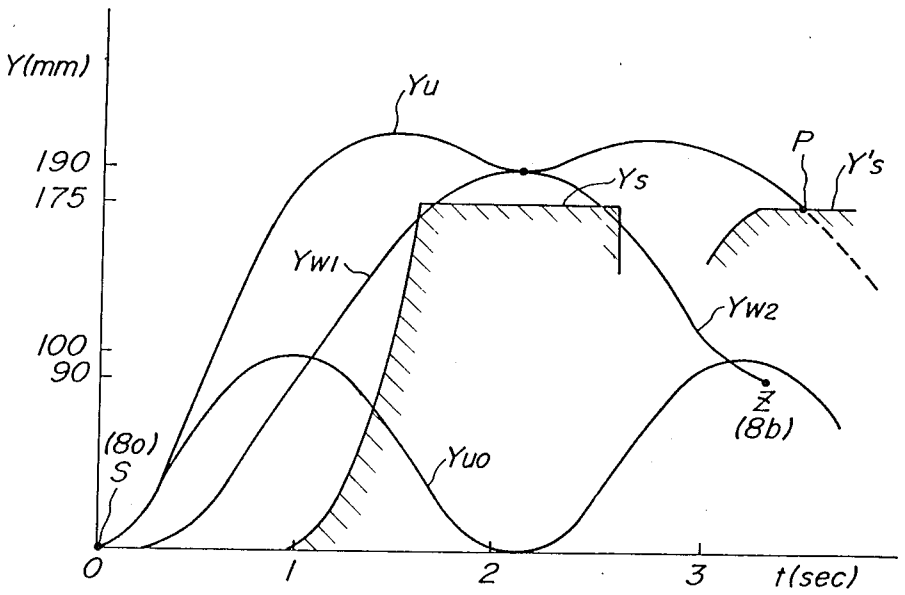

FIG. 13*d* illustrates the preforming the trailing end of the slab. After the steady reduction has been completed, the crankshaft continues its rotation to the upper dead point, during which the anvil moves along a curve $Y_{uo}$. On the other hand, the width adjustment starts slightly behind the point S in the direction opening the pair of anvils to a value of 190 mm and then is once stopped as shown in a curve $Y_{w1}$. Thereafter, as shown in a curve $Y_{w2}$ the width adjustment again starts in the direction closing the anvils to a value of 100 mm and thereafter the width adjustment is stopped at a point Z where the preforming of 85 mm at the trailing end is possible in the first stage preforming. During the width adjustment, the slab is moved and is stopped when the trailing end 7' of the slab arrives at a point B of the anvil. On the other hand, $Y_s$ increases progressively and passes through a point of 175 mm which has not been reduced, and the trailing end 7' intersects the line $Y_s$. Moreover, $Y_s'$ indicates the distance in width to be reduced by one anvil in the vertical direction passing through the point B of the anvil. Moreover, the actual movement of the anvil corresponds to a line $Y_u$ so that the gap of 15 mm can be maintained even when the anvil and the slab approach to each other to the minimum possible distance. The reduction in width starts from the point P where the curves $Y_u$ and $Y_s'$ intersects. Thereafter, the second stage preforming at the trailing end of the slab is effected in the same manner as shown in FIG. 13*b*.

Moreover, in the case that the preforming the trailing end is effected prior to the preforming the preceding end, it can be carried out by the use of the inclined portions 15*a* of the anvils on the exit side in the same manner as in the preceding end, although the case is not shown in drawings.

As can be seen from FIGS. 13*a*–13*d*, there is no interference between the side edge of the slab and the movement of the anvil shown in the line $Y_u$, prior to the point P where the reduction starts. As shown in FIGS. 13*a* and 13*d*, particularly, it is clear that the adjustment of reduction position of the anvil can be easily and simply effected during the rotation of the crankshaft.

According to the invention, the reducing distance can be set according to the desired distance of reduction in width in continuous width reduction including the preforming of a slab, and the reduction in width of slabs can be continuously effected with the set reducing distance with high efficiency.

The buckling is likely to occur when the reduction in width of the slab is effected as we mentioned in the preamble in the specification.

The inventors of the invention have investigated the occurrence of the buckling to find that such a buckling throughout a slab from its preceding end to its trailing end can be prevented by holding the slab at more than two locations along a rolling direction or a longitudinal direction of the slab by means of, for example, rollers.

FIG. 14 illustrates the result of experiments for determining the optimum positions of holding rollers for preventing the buckling in the respective patterns of pressing. With preformed preceding end (a) and preformed trailing end (c), the buckling is prevented by holding the slab at a location x in the proximity of its end which is being reduced by the parallel portions 23 of anvils. In steady pressing (b), moreover, the buckling is prevented by holding the slab at a location which is substantially at a center of a line connecting centers of the parallel portions of the pair of anvils. In case of non-preforming (d), the best way to prevent the buckling is to continuously hold the rearmost end of the slab from the commencement of the deformation of the trailing end to the termination of the reduction of the trailing end. In any cases, it is of course that the slab is held at each the location shown by x in FIGS. 14 and 15 by a pair of holding rollers located on both sides of the slab.

From the results above described, in order to prevent any buckling by minimum holding points, holding rollers at at least two locations C and D are needed as shown in FIG. 15. Namely, the location C is at a center of a line connecting centers of parallel portions 23 of a pair of anvils to prevent the buckling in preforming the preceding and trailing ends. A length lp of the parallel portion 23 is determined by an amplitude $2a$ of the reciprocative movements of the anvil and an inclined angle $\theta$ and approximately $lp=(1.0\sim1.5)\cdot 2Fa/\tan\theta$. Therefore, the location C is located in the proximity of the preceding or trailing end of the slab in preforming. The location D is at a center of a line connecting the rearmost edges of the slab in contact with the inclined portions 24 of the anvils to prevent the buckling in normal pressing or non-preforming reduction.

If a space is allowed, it is preferable to hold the slab at three locations as shown in FIG. 16. Namely, in addition to the location C, holding rollers are located at a second location D' which is at a center of a line connecting substantial centers of edges of the slab in contact with the inclined portions of the anvils and at a third location E which is at a location on opposite side to the position of the second location D' with respect to a line connecting rearmost edges of the slab in contact with the inclined portions of the anvils. This arrangement is intended to hold the slab at the location D' in steady pressing and at the locations D' and E in non-preforming which is prone to buckling.

One embodiment residing in the new discovery above described will be explained by referring to FIG. 17. Two pair of holding rollers 26 and 27 ones above the others are located one pair of the rollers on each side of a junction 25 of a parallel portion 23 (450 mm length) of an anvil 22 and an inclined portion 24 (800 mm length and angle 13°) on an entry side. The holding rollers 26 and 27 above the slab are urged against the slab 21 by means of hydraulic cylinders 28 and 29.

The holding rollers 26 are located at the location D on a line connecting centers of the parallel portions 23 of the pair of anvils 22, while the holding rollers 27 are located at the location D' on a line connecting centers of the inclined portions 24 on the entry side.

In FIG. 17, reference numeral 30 denotes pinch rollers.

The buckling is likely to occur in case of wider slabs. The inventors carried out the width reduction of slabs having 220 mm thickness, 2200 mm width and 6000 mm length by the use of a press apparatus capable of width reduction of 350 mm. An amplitude of the anvils was 85 mm. Any buckling did not occur in the slabs, some of which were preformed at their preceding and trailing ends and some of which were steadily pressed without preforming.

FIG. 18 illustrates another embodiment using holding rollers 26, 27 and 31 located at three locations. The holding rollers 26, 27 and 31 above a slab 21 are urged against the slab by means of hydraulic cylinders 28, 29 and 32.

Like components have been designated by the same reference numerals as those used in FIG. 17 will not be described in further detail.

It is the best condition to hold the slab at three locations. A location A of the holding rollers 26 is substantially at a center of the parallel portion 23 of an anvil 22. A location D' of the holding rollers 27 is substantially at a center of the inclined portion 24 of the anvil 22 on an entry side. A location E of the holding rollers 31 is located slightly spaced from an end of the anvil on the entry side.

The inventors carried out the width reduction of slabs having 220 mm thickness, 2200 mm width and 6000 mm length by the use of the press apparatus capable of width reduction of 350 mm. Any buckling did not occur in the slabs, some of which were preformed at their preceding and trailing ends and some of which were normally pressed without preforming.

In case of greatly reducing widths of hot slabs with the press apparatus, according to the invention the buckling occurring in the slabs is most effectively prevented in preforming preceding or trailing ends of the slabs or steady pressing of the slabs to improve the efficiency in working operation and to prevent troubles in following rolling.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A method of reducing widths of hot slabs using eccentric presses for reciprocatively driving through sliders width reduction heads to which are respectively attached a pair of anvils movable toward and away from each other in width directions of the hot slabs, each said anvil having a parallel portion in parallel to a feeding direction of the hot slabs and an inclined portion on an entry side in the feeding direction, comprising steps of setting a distance to reduce a widths of a slab either side by said anvils by moving said width reduction heads toward and away from said sliders, and feeding the hot slab intermittently with a pitch determined by a shape of said anvils and reducing conditions to effect the reduction in width of the slab in succession, wherein the method comprises steps of setting a distance between said anvils corresponding to a lower dead point of a crankshaft of each of said eccentrical presses at a value somewhat wider than a width of the hot slab, then feeding the hot slab to a predetermined position relative to the anvils, adjusting each of said width reduction heads in a direction opening the anvils during an opening stroke of the slider to obtain a distance to be reduced by one anvil in a first stage preforming, then effecting the first stage preforming during a closing stroke of the slider, thereafter adjusting each of said width reduction heads to obtain a distance according to an aimed reduced distance in the same manner as in the first stage preforming and effecting preforming during a closing stroke of the slider in the same manner as in the first stage in required times, and wherein the method further comprises steps of making a minimum distance between the anvils equal to the aimed reduced distance in steady width reduction of the hot slab, setting the distance to be reduced of the hot slab within a range in which the anvils and the hot slab do not interfere with each other during its advancing, feeding the hot slab during the opening stroke of the slider through a distance determined by the distance to be reduced and an angle of the inclined portion on the entry side, and repeating the cycle for reducing to the aimed reduced distance during the closing stroke of the slider to effect the reduction in width progressively.

2. A method of reducing widths of hot slabs as set forth in claim 1, wherein said hot slab being subjected to the reduction in width is held at least two locations of the slab along a central longitudinal line of the slab and on upstream and downstream sides of a line connecting junctions of the parallel portions and the inclined junctions of the parallel portions and the inclined portions of the anvils, thereby preventing any buckling of the slab occurring in reduction in width of the slab wherein the one location is located at a center of a line connecting substantial centers of the parallel portions of the anvils and the other location is located at a center of a line connecting rearmost edges of the slab in contact with the inclined portions of the anvils.

3. A method of reducing widths of hot slabs as set forth in claim 1, wherein the one location is located at a center of a line connecting centers of the parallel portions of the anvils, second location is located at a center of a line connecting substantial centers of edges of the slab in contact with the inclined portions of the anvils, and third location is located at a location on opposite side to the position of the second holding means with respect to a line connecting rearmost edges of the slab in contact with the inclined portions of the anvils.

* * * * *